US007252517B2

(12) United States Patent
Ju

(10) Patent No.: US 7,252,517 B2
(45) Date of Patent: Aug. 7, 2007

(54) ELECTRIC CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/377,299

(22) Filed: Mar. 17, 2006

(65) Prior Publication Data

US 2007/0049066 A1 Mar. 1, 2007

(30) Foreign Application Priority Data

Aug. 24, 2005 (CN) ..... 2005 2 0063327

(51) Int. Cl.
*H01R 12/00* (2006.01)

(52) U.S. Cl. ..... 439/73; 439/331

(58) Field of Classification Search ..... 439/73, 439/331

See application file for complete search history.

(56) References Cited

U.S. PATENT DOCUMENTS 4,560,217 A * 12/1985 Siano ..... 439/68
6,344,971 B1 * 2/2002 Ju ..... 361/704
6,752,636 B2 * 6/2004 Ma ..... 439/73
6,799,978 B2 * 10/2004 Ma et al. ..... 439/73
6,991,474 B1 * 1/2006 Ju ..... 439/73
2004/0121630 A1 * 6/2004 Ma et al. ..... 439/73
2007/0049066 A1 * 3/2007 Ju ..... 439/73

* cited by examiner

*Primary Examiner*—James R. Harvey
(74) *Attorney, Agent, or Firm*—Troxell Law Office, PLLC

(57) ABSTRACT

An electric connector, by which a chip module can be attached to a circuit board, comprises an insulating body further provided with a pair of metallic reinforcing plates on two opposite sides thereof, a plurality of conducting terminals and a retaining structure detachable from the insulting body that can retain the chip module within the insulating body. The retaining structure is a pair of driving rods pivotally connected to two sides of the insulating body that are not attached with the reinforcing plates. The electric connector assures more stable electric connection between the chip module and the circuit board and is difficult to deform due to its metallic reinforcing plates.

6 Claims, 5 Drawing Sheets

ELECTRIC CONNECTOR

BACKGROUND OF THE INVENTION (a) Field of the Invention

The present invention relates to electric connectors, more particularly to an electric connector by which a chip module can be attached to a circuit board.

(b) Description of the Prior Art

The electric connectors of the prior art by which a chip module can be attached to a circuit board are usually classified into two types. An electric connector of the first type comprises an insulating mount and an upper cover coupled with the insulating mount. There is further a driving stick installed between the insulating mount and the upper cover. The insulating mount further includes a plurality of receptacle grooves for housing conducting terminals, whereas the upper cover is provided with a plurality of through holes corresponding to the receptacle grooves, whereby the foot pins of a chip module can go through the through holes on the upper cover and electrically connect the conducting terminals disposed within the insulating mount. Thereby, the chip module will attach to a circuit board. However, the insulating mount and the upper cover are made of a plastic material, of which the upper cover is easy to get deformed due to its low strength. Moreover, the mount will get deformed after repetitious application of the driving stick. Therefore, the electric conduction between the circuit board and the chip module will be influenced. For this disadvantage, electric connectors of the send type each comprises an upper iron shell, a lower iron shell, a driving stick and an insulating body wherein a plurality of conducting terminals are located. The lower iron shell is a rectangular frame for housing the insulating body. The conducting terminals are housed in the insulating body, each with one end soldered onto a circuit board. However, when the driving stick is twisted downward so as to close the upper cover, the lower cover may experience a non-uniform clipping force and get deformed, and the insulating body mounted on the lower cover will get deformed at the same time, which may urge some of the conducting terminals to depart from the circuit board. Therefore, the electric connection between the board and the module will be badly influenced. Further, iron shells of the second type will increase the weight of the electric connectors and cost more.

Therefore, it is necessary to invent a new electric connector that overcomes the above disadvantages.

SUMMARY OF THE INVENTION

The primary objective of the present invention is to provide an electric connector by which a chip module will be electrically connected to a circuit board with stability.

Accordingly, an electric connector of the present invention for achieving the electric connection comprise an insulating body, a plurality of conducting terminals and a retaining structure that can retain a chip module within the insulating body. The insulating body further includes a pair of grooves respectively on two opposite sides thereof for housing metallic reinforcing plates.

Further, the electric connector of the present invention for attaching a chip module onto a circuit board comprises an insulting body, a plurality of conducting terminals and a retaining structure retaining structure that retains the chip module within the insulating body. The retaining structure is a pair of driving rods installed on two opposite sides of the insulating body. Further, at least one side of the insulting body not connected to driving rods is provided with a metallic reinforcing plate.

Compared with the current technology, the electric connector of the present invention assures more stable electric connection between the chip module and the circuit board and is difficult to deform due to its metallic reinforcing plates.

The various objects and advantages of the present invention will be more readily understood from the following detailed description when read in conjunction with the appended drawings.

DETAILED DESCRIPTION OF THE PREFERRED EMBODIMENTS

Figure 1:
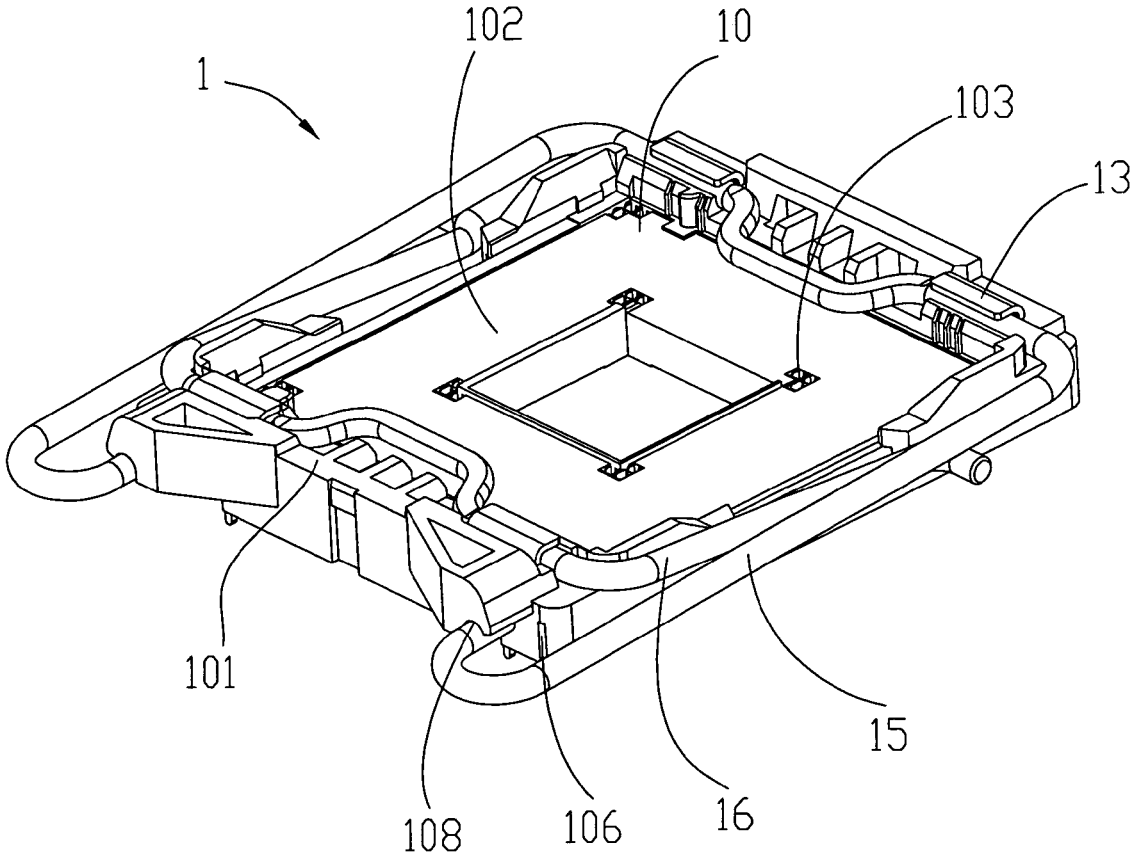
FIG. 1 is a perspective view of an electric connector of the present invention.
Figure 2:
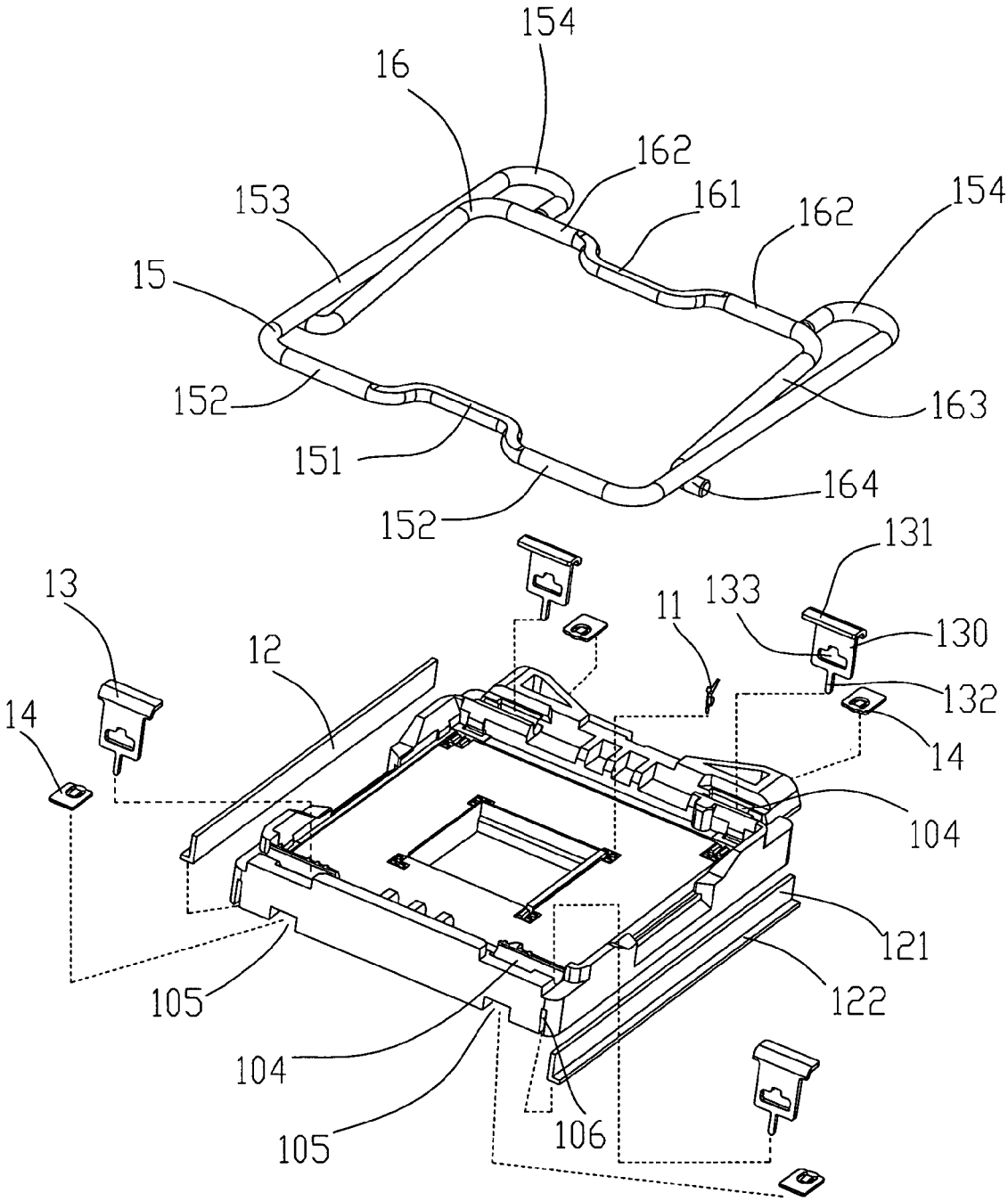
FIG. 2 is an exploded perspective view of the electric connector in FIG. 1.
Figure 3:
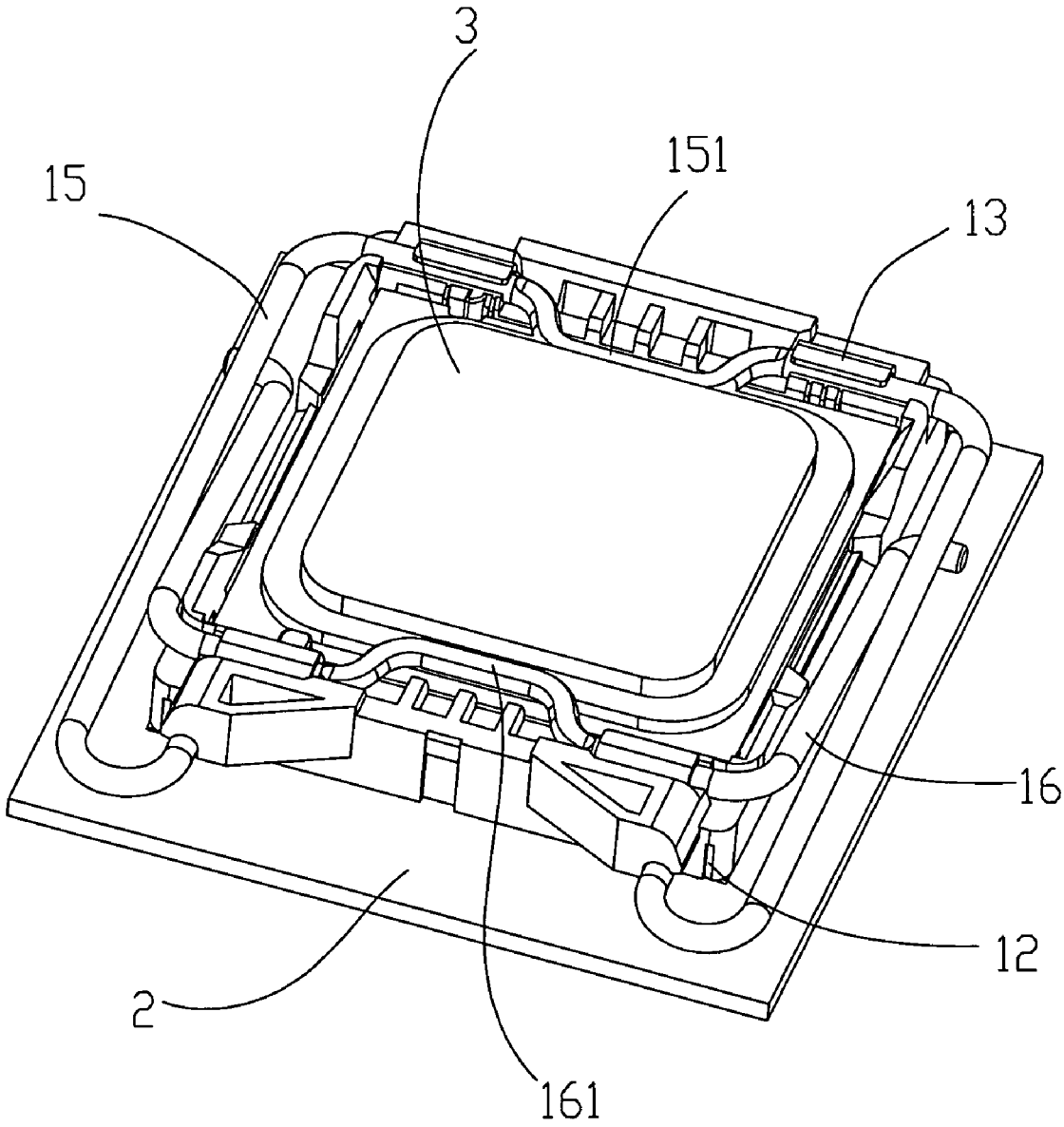
FIG. 3 is a perspective view of the electric connector in FIG. 1 mounted on a circuit board.

Referring to FIG. 1 to FIG. 3, an electric connector 1 of the present invention is mounted on a circuit board 2 for connecting a chip module 3 to the circuit board 2. The electric connector 1 comprises an insulating body 10, a plurality of conducting terminals 11 and a retaining structure pivotally mounted on the insulating body 10 for retaining the chip module 3 within the insulating body 10, The retaining structure in the first preferred embodiment is two pivotal rods. The electric connector 1 further includes a pair of metallic reinforcing plates 12 installed on two opposite sides of the insulating body 10. (It is of course all right that only one metallic reinforcing plate is installed; installing two metallic reinforcing plates is better.)

The insulating body 10 is a square frame having a surrounding frame 10 with an inner conducting rim 102. The inner conducting rim 102 further includes a plurality of receptacle holes 103 for housing the conducting terminals 11. (The receptacle holes 103 are not a main feature of the present invention, and therefore they are partially disclosed by the figures.) Two opposite sides of the frame are each provided with retaining holes 104, and the bottom surface of the insulating body 10 are provided with retaining grooves 105 respectively corresponding to the retaining holes 104. Further, the other two opposite sides without the retaining holes 101 are respectively provided with slots 106 for housing metallic reinforcing plates 12. A side of the frame 101 with a pair of retaining holes 104 is further provided with a pair locking grooves 108 close to two ends thereof.

Each of the metallic reinforcing plates 12 comprises a vertical wall 121 for being inserted into a corresponding slot 106 on the insulating body 10 and a horizontal base 122 located beneath the bottom surface of the insulating body 10.

The electric connector further comprises pivot pieces 13 connected to the insulating body 10 and retaining pieces 14 that fix the pivot pieces 13 at the insulating body 10. Each of the pivot pieces 13 includes a main body 130, a retaining section 131 folded toward the interior of the insulating body 10, a soldering tip 132 extended downward from the main body 130 and a locking hole 133 formed on the main body 130.

Two pivotal rods are respectively the upper pivotal rod 15 and the lower pivotal rod 16, each having a pressing section (151, 161) for retaining the chip module 3, an axial section (152, 162) pivotally mounted on the insulating body 10, an operating section (153, 163) located away from the axial section (152, 162). The lower pivotal rod 16 further includes a pair of engagement ends 164 being vertical to the operating section 163 that will be pressed against by the operating section 153 of the upper pivotal rod 15. The upper pivotal rod 15 further includes a pair of folded ends 154 at the ends of the operating section 153, which can be locked in the locking grooves 108 of the insulating body 10 when the upper rod 15 pivoting downwardly to the insulating body 10. When the upper rod 15 pivoting downwardly, the operating section 153 of the upper pivotal rod 15 will press against the engagement ends 164 to bring the lower pivotal rod 16 pivoting downwardly.

To install the upper pivotal rod 15 the insulating body 10, the axial section 152 is placed on the retaining holes 104, and then the soldering tips 132 of the pivot pieces 13 are inserted into the retaining holes 104 whereby the retaining sections 131 of the pivot pieces 13 will engage with the axial section 152. Finally, the retaining pieces 14 pare inserted into the locking hole 133 of the pivot pieces 13, whereby the upper pivotal rod 15 is attached on the insulating body 10 by the pivot pieces 13. The lower pivotal rod 16 is mounted on the insulating body 10 likewise.

To connect the electric connector 1 and the circuit board 2, the four soldering tips 132 of the four pivot pieces 13 are inserted into corresponding holes on the circuit board 2 and then soldered. Thereby, the electric connector 1 will be stably mounted on the circuit board 2. A chip module 3 is then disposed into the inner conducting rim 102 of the electric connector 1, whereby the contact points will be contacted with the contact ends of the conducting terminals 11. The upper pivotal rod 15 and the lower pivotal rod 16 will be folded inwardly so that the pressing sections 151, 161 thereon can retain two opposite sides of the chip module 3, assuring a good electric conduction between the circuit board 2 and the chip module 3.

Because of the metallic reinforcing plates embedded within the slots on two opposite sides of the insulating body, the insulating body will not be easily deformed when it is mounted on the circuit board, therefore avoiding influencing the electric connection between the chip module and circuit board. Further, the electric connector of the present invention uses two pivotal rods to attach the chip module onto the circuit board, which is structurally simple and costs less.

Figure 4:
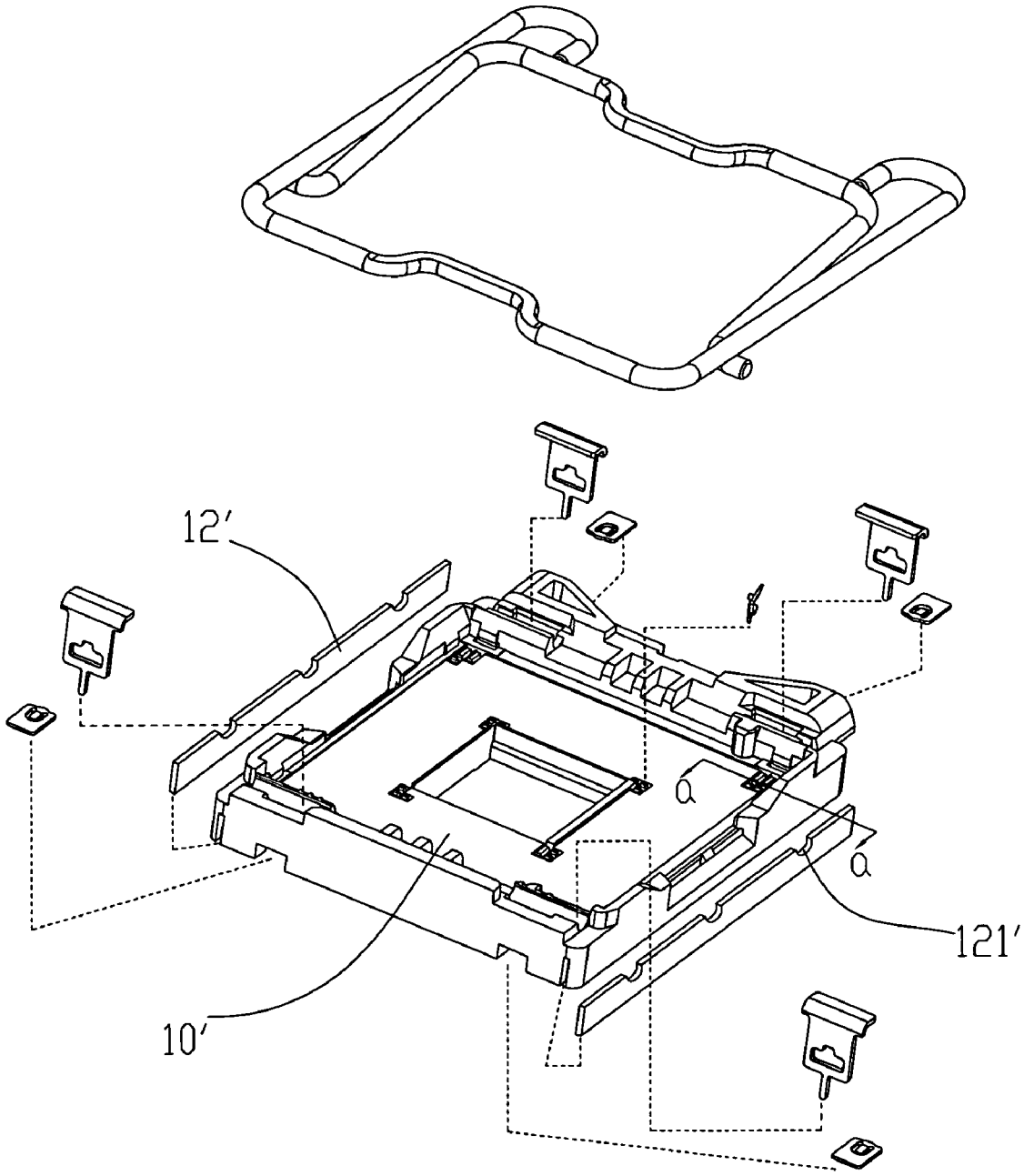
FIG. 4 is an exploded perspective view of the second preferred embodiment of the present invention.
Figure 5:
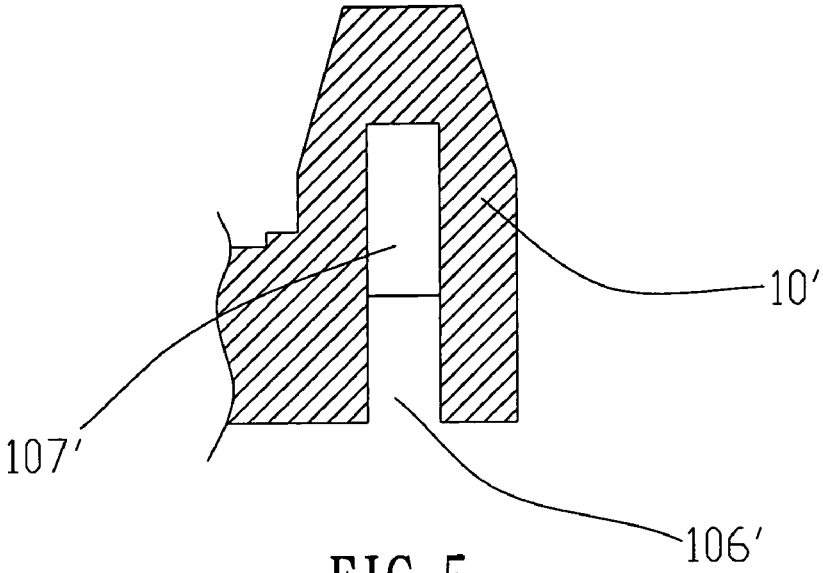
FIG. 5 is a cross-sectional view of the electric connector in FIG. 4 across the a-a line.
Figure 6:
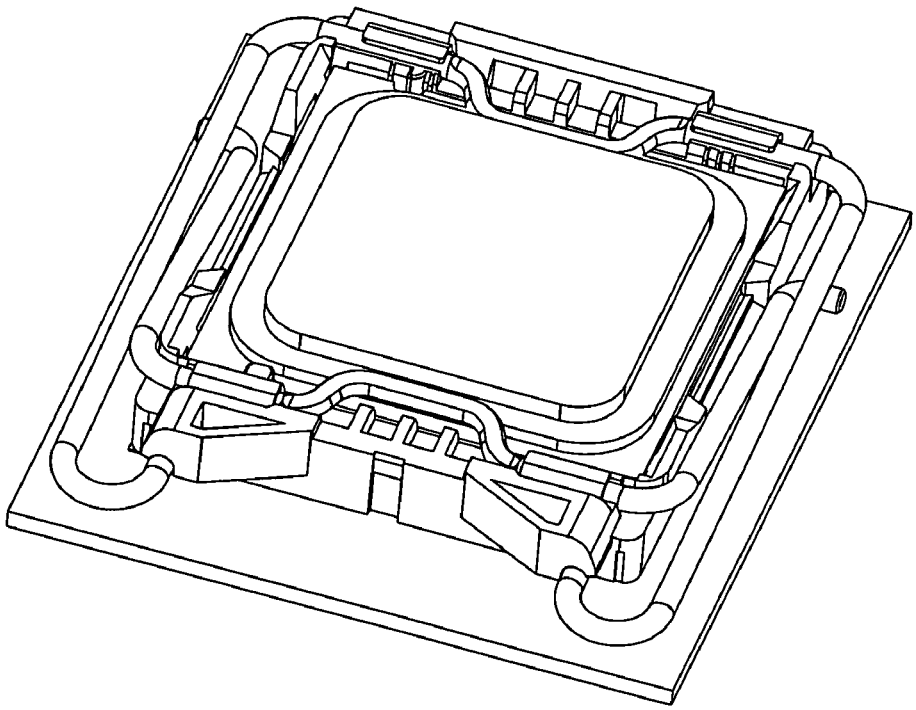
FIG. 6 is a perspective view of the electric connector in FIG. 4.

Referring to FIG. 4 to 6, the second preferred embodiment of the present invention as an electric connector is different from the preferred embodiment in that the metallic reinforcing plates 12' are slabs with three upper notches 121' (also can be one or two or more than three), and there are rib-like strips 107' housed within the insulating body 10' above the slots 106', respectively corresponding to those notches 121'. Thereby, the rib-like strips 107', together with the reinforcing plates 12' will enhance the toughness of the insulating body 10'.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electric connector, by which a chip module can be attached to a circuit board, comprising:

an insulating body, said insulating body further including a pair of grooves respectively on two opposite sides thereof for housing metallic reinforcing plates;

a plurality of conducting terminals; and a retaining structure pivotally mounted on and detachable from said insulting body that can retain said chip module within said insulating body wherein said metallic reinforcing plates are slabs each with at least a notch on an upper side thereof; said insulating body including rib-like structures corresponding to and housed by said notches; each of said rib-like structures connecting two inner lateral walls of each of said slots.

2. The electric connector of claim 1 wherein each of said metallic reinforcing plates comprises a vertical wall for being inserted into a corresponding one of said slots on said insulating body and a horizontal base located beneath a bottom surface of said insulating body.

3. The electric connector of claim 1 wherein said retaining structure are two pivotal rods installed on two opposite sides without metallic reinforcing plates of said insulating body for respectively pinching two lateral sides of said chip module.

4. The electric connector of claim 3 wherein said pivotal rods are an upper pivotal rod and a lower pivotal rod each having a pressing section for retaining said chip module, an axial section pivotally mounted on said insulating body, an operating section located away from said axial section; said lower pivotal rod further including a pair of engagement ends being vertical to said operating section that will be pressed against by said operating section of said upper pivotal rod.

5. An electric connector, by which a chip module can be attached to a circuit board, comprising:

an insulating body further provided with a pair of metallic reinforcing plates on two opposite sides thereof;

a plurality of conducting terminals; and a retaining structure pivotally mounted on and detachable from said insulting body that can retain said chip module within said insulating body, said retaining structure being a pair of pivotal rods pivotally connected to two sides of said insulating body that are not attached with said reinforcing plates wherein said pivotal rods are an upper pivotal rod and a lower pivotal rod each having a pressing section for retaining said chip module, an axial section pivotally mounted on said insulating body, an operating section located away from said axial section; said lower pivotal rod further including a pair of engagement ends being vertical to said operating section that will be pressed against by said operating section of said upper pivotal rod, wherein two opposite lateral sides of said insulating body are each provided with a slot for housing a corresponding one of said metallic reinforcing plates. wherein said metallic reinforcing plates are slabs each with at least a notch on an upper side thereof: said insulating body including rib-like structures corresponding to and housed by said notches: each of said rib-like structures connecting two inner lateral walls of each of said slots.

6. The electric connector of claim 5 wherein each of said metallic reinforcing plates comprises a vertical wall for being inserted into a corresponding one of said slots on said insulating body and a horizontal base located beneath a bottom surface of said insulating body.

* * * * *